United States Patent [19]

Shimizu et al.

[11] Patent Number: 4,963,186

[45] Date of Patent: Oct. 16, 1990

[54] METHOD FOR OPERATING BLAST FURNACE BY ADDING SOLID REDUCING AGENT

[75] Inventors: Masataka Shimizu, Kobe; Ryuichi Hori, Kakogawa; Yoshio Kimura, Akashi; Fumio Noma, Kobe; Mitsutoshi Isobe, Kakogawa; Tsunao Kamijo, Kobe; Shinichi Inaba, Kakogawa, all of Japan

[73] Assignee: Kabushiki Kaisha Kobe Seiko Sho, Hyogo, Japan

[21] Appl. No.: 239,655

[22] Filed: Sep. 2, 1988

[30] Foreign Application Priority Data

Sep. 3, 1988 [JP] Japan ..... 62-220981
Sep. 3, 1988 [JP] Japan ..... 62-220982
Sep. 3, 1988 [JP] Japan ..... 62-220983
Sep. 3, 1988 [JP] Japan ..... 62-220985

[51] Int. Cl.[5] ..... C21B 5/00

[52] U.S. Cl. ..... 75/378; 75/382; 75/387; 75/469

[58] Field of Search ..... 75/41, 42, 378, 382, 75/387, 469

[56] References Cited

U.S. PATENT DOCUMENTS 2,671,017 3/1954 McCutcheon ..... 75/42

FOREIGN PATENT DOCUMENTS 23012 2/1979 Japan ..... 75/41

*Primary Examiner*—Melvyn J. Andrews
*Attorney, Agent, or Firm*—Oblon, Spivak McClelland, Maier & Neustadt

[57] ABSTRACT

Disclosed herein is a method for operating blast furnace, wherein, when charging coke and ore alternately from the furnace top to form alternate coke and ore layers for operation of a blast furnace, a coke layer is formed by charging coke of properties especially suitable for improvement of gas and liquid permeability of the coke layer to the central part thereof or an ore layer is formed by charging ordinary versatile type coke to the central part of the ore layer prior to formation thereof. The centrally charged coke forms a major part of the dead coke layer which is sequentially renewed under the cohesive zone of the blast furnace to maintain appropriate gas and liquid permeability of the dead coke layer, thereby enhancing the production efficiency and stability of the blast furnace operation while suppressing erosive wear of refractory walls of the furnace.

5 Claims, 13 Drawing Sheets

METHOD FOR OPERATING BLAST FURNACE BY ADDING SOLID REDUCING AGENT

FILED OF THE ART

This invention relates to a method for operating blast furnaces, which can prolong the service life of blast furnace by maintaining good gas permeability and liquid permeability of solid reducing agent layers in the dead-man of the blast furnace thereby enhancing the operational efficiency and stability of the furnace while suppressing the erosive wear of refractory walls of the furnace.

In the following description, the invention is explained by way of furnace operations using coke which is a typical solid reducing agent.

PRIOR ART

In order to operate a blast furnace stably and efficiently, it is important to control appropriately the distribution of the climbing gas within the furnace. For instance, in FIG. 1 which is a sectional schematic of a blast furnace in operation, indicated at O is ore, at C is coke, at K is a lumpy zone, at SM is a softened cohesive zone, at Co is coke in the dead-man of the furnace, at L is a laceway, at B are tuyeres, at F is molten pig iron. Namely, the alternate layers of the ore O and coke C which have been charged through the top of the furnace are gradually lowered, and, while descending through the lumpy zone K, the ore O is gradually reduced by the action of the reducing gas (Co) which is produced by reaction between the coke and the hot blasts which are blown into the furance through the tuyeres B. After forming the softened cohesive zone SM, it is passed through the gaps in the dead coke layer Co and pooled on the hearth of the furnace. This molten pig iron is periodically or continuously drawn out through a tap E.

There have been made various proposals with regard to the control method for improving the efficiency and stability of such blast furnace operations. According to the concept which is almost established in the art, it is considered that the furnace operation attains the highest level in efficiency and stabilizes when the softened cohesive zone SM is maintained in V-shape by centralizing the climbing gas streams in the furnace, as disclosed in the Applicants' Japanese Laid-Open Patent Application No. 60-56003 and in Japanese Patent Publication No. 61-42896 and Laid-Open Patent Application No. 61-227109. To secure such operating condition, studies for improvements are being made by various approaches such as the method for charging the ore O and coke C, the shape of the alternately piled layers and the gas permeability. However, most of these studies are mainly directed to the improvement of the shape of the softened cohesive zone SM or the optimization of the climbing gas flows, or to the improvement of the shape of the alternately piled layers of ore O and coke C, which are also the subject matter of the above-mentioned Japanese Patent Publications. Contrarily, there have been made no studies with regard to the influences which are imposed on the operational efficiency by the condition of the core coke layer Co under the softened melting zone SM.

On the other hand, the ore, the raw material to be charged into the blast furnace, contains Zn in the form of sulfide (ZnS), ferrite ($2ZnO.Fe_2O_3$), silicate ($2ZnO.SiO_2$) and the like, which are substances of low melting point and easily decomposable. Therefore, upon reaching a region of temperatures 900°-1000° C. in the furnace, they are once decomposed into ZnO, and reduced to gaseous Zn by reaction with C, CO and $H_2$ as expressed by the following reaction formulas.

$$ZnO+C=Zn+CO-55370(Kcal)$$

$$ZnO+CO=Zn+CO_2-15770(Kcal)$$

$$ZnO+H_2=Zn+H_2O-25640(Kcal)$$

Thus gasified Zn is partly discharged out of the furnace along with the furnace gas and partly condensed within the upper ore layers in the furnace or otherwise oxidized and deposits in the form of an oxide. The Zn compounds which has been condensed or deposited in this manner are brought again into the high temperature zone as the ore layers are lowered, and reduced and gasified again, the resulting Zn gas partly climbing toward the furnace top and partly condensing and depositing once again withing the upper ore layers. As these cycles are repeated, the amount of deposition is gradually increased, in some cases reaching a concentration about ten times as large as the concentration at the time of charging. Besides, it is considered that the ore layers have a function of acting as a filter layer for the climbing gas streams, thereby promoting the condensation and circulation of Zn.

The charging material contains alkali metals such as K, Na and the like in the form of alkali silicates (e.g., $2K_2O.SiO_2$, $K_2O.SiO_2$ and the like), which are reduced to alkali metals and gasified while the material is lowered in the furnace, the resulting gases which climb the furnace, similarly to Zn, being partly discharged out of the furnace along with the furnace gas and partly being cooled off, depositing in the ore layers in the form of carbonate and cyan compounds, and lowered again together with the ore layers, thus circulating in the furnace by repeating the gasification and deposition. This process of circulation is shown in FIG. 2, and also discussed in a literature (J. Davies: Ironmaking and Steelmaking, 5(1978), P151).

Thus, Zn and low melting point substances like alkali metals have a tendency of circulating and accumulating in the furnace. The the accumulation finally reaches an excessive amount which impairs the gas permeability, while the amount of deposition increases not only in the ore layers but also on the furnace walls, giving rise to the phenomenon of the so-called "sticky wall" which impedes the lowering of the charged material to cause serious problems such as unsymmetrical consumption, slipping, and hanging. In addition, the acumulation of alkali metals is considered to be one of the causes which promote the erosive wear of the refractory bricks.

SUMMARY OF THE INVENTION

In the operation of blast furnace, coke and ore are alternately charged through the top of a furnace to form alternate coke and ore layers, while the ore is continuously reduced by the action of a reducing gas (CO) which is produced by reaction of the coke with hot blasts blown in through the tuyeres and the molten pig iron gathering on the hearth of the furnace is periodically or continuously drawn out for continuous operation. For enhancing the efficiency and stability of such a blast furnace operation, it is considered a matter of utmost importance to centralize the climbing gas streams in the furnace to maintaining the softened melting zone in an inverted V-shape. The shape of the softened cohesive zone is considerably influenced by the gas permeability and liquid permeability of the dead coke layer formed beneath the softened cohesive zone. The liquid permeability of the dead coke layer also imposes a great influence on the speed of erosive wear of the refractory walls of the hearth.

In view of these influences of the gas and liquid permeability of the dead coke layer, it is an object of the present invention to maintain high efficiency and stability of the blast furnace operation while suppressing erosive wear of refractory walls around the hearth of the furnace to ensure a prolonged service life of the furnace, by maintaining appropriate gas and air permeabilities of the dead coke layer. More specifically, optimum gas and liquid permeability of the dead coke layer is maintained by controlling the amount of the coke, which is charged into a centeral part of the furnace through its top, to an appropriate ratio (a weight ratio to the total amount of coke charging) as well as the central charging region. It is another object of the invention to enhance the gas permeability of the center portion of the furnace by controlling the ratio of the coke charging to the centeral region and the central charging region, thereby centralizing the climbing gas streams to stabilize the furnace condition and elevating the centralized gas temperature to prevent condensation and deposition of the low melting point metal vapors entrained in the centralized gas streams to maintain the furnace condition in a more stabilized state. Other object of the invention will become apparent from the following description taken in conjunction with the accompanying drawings.

DETAILED DESCRIPTION OF THE INVENTION

The present inventors have been conducting studies for the enhancement of efficiency and stability of the blast furnace operation, and have come upon the following facts by statistically compiling the results of surveys on a large number of blast furnaces overhauled in the past and by simulating the migration of substances in the blast furnace.

Figure 1:
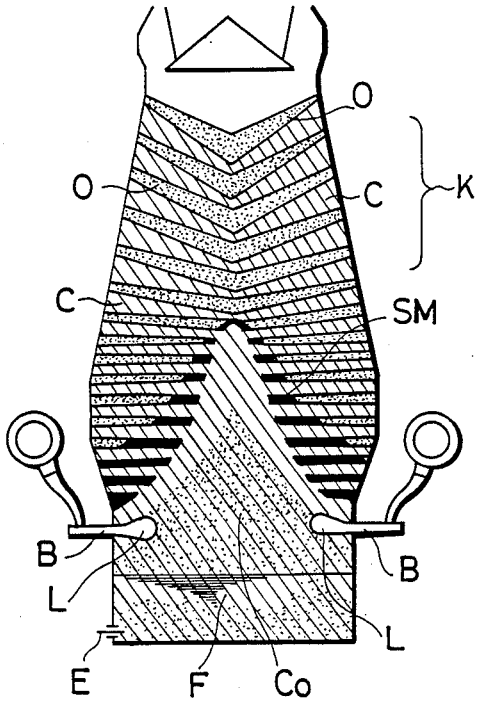
Fig. 1 Prior Art
FIG. 1 is a vertically sectioned schematic view of a blast furnace, showing the internal condition of the furnace in operation.
Figure 2:
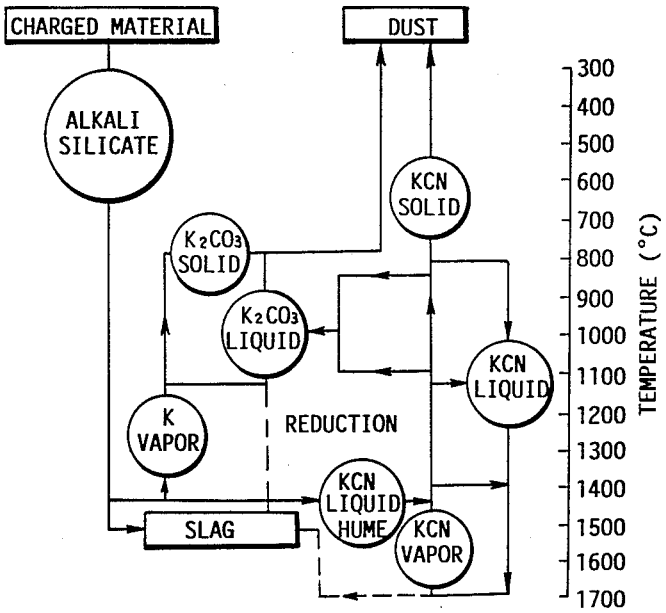
Fig. 2 Prior Art
FIG. 2 is a flowchart of the process of alkali metal circulation in the blast furnace.
Figure 3:
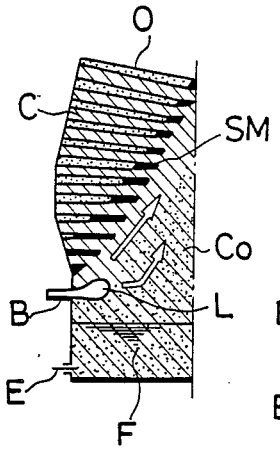
FIG. 3 is a fragmentary schematic view in vertical section of a blast furnace in operation in instable state.
Figure 4:
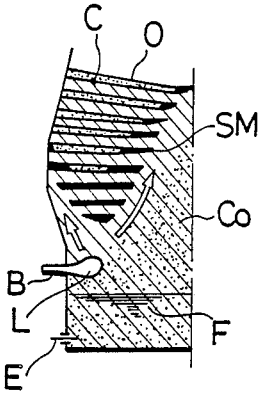
FIG. 4 is a fragmentary schematic view in vertical section of a blast furnace in operation in instable state.

Namely, the first fact is that the shape of the softened cohesive zone is largely influenced by the degree of gas permeability of the dead coke layer Co. When the dead coke layer Co has good gas permeability, the blown-in gas forms centralized gas streams along the center axis of the furnace, maintaining the softened cohesive zone SM appropriately in inverted V-shape to keep stable operating condition of the furnace. Conversely, if the gas permeability of the dead coke layer Co becomes low, the climbing gas flow is dominated by peripheral streams which eventually changes the softened cohesive zone SM into W-shape, rendering the operating condition of the furnace extremely instable. This phenomenon can be explained by way of the partly sectioned schematics of FIGS. 3 and 4. Namely, FIG. 3 shows the condition in which the gas permeability of the core coke layer Co is maintained at a suitable level. In this case, the hot blasts which are blown in through the tuyeres B can easily make way into the center portion of the dead coke layer Co, so that the gas streams around the center axis of the furnace are increased, and the climbing gas forms centralized streams, stably holding the softened cohesive zone SM in inverted V-shape. The softened cohesive zone SM which is formed in inverted V-shape encourages the trend of centralization of the gas treams all the more. On contrary, FIG. 4 shows the furnace condition in which the dead coke layer Co has low gas permeability. In this case, the dead coke layer Co has large resistance to gas flows, so that the hot blasts blown in through the tuyeres B are forced to shunt toward the furnace walls. As a result, the ore in the peripheral portions are subjected to reduction at an early position (high position), and the softened cohesive zone SM is turned to W-shape, further minimizing the resistance to vertical gas flows in the periperal portions close to the furnace walls to encourage the peripheral streams of the climbing gas all the more. Thus, the furnace condition is extremely instabilized. Besides, the formation of such peripheral gas streams invites accumulation of a considerable amount of Zn and other circulating metals of low melting point like alkali metals, further deteriorating the furnace condition.

Figure 5:
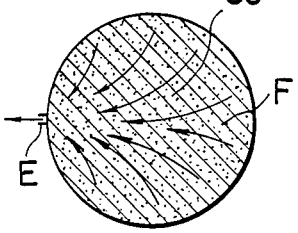
FIGS. 5 and 6 are schematic cross-sectional views of a furnace, showing the flow of molten pig iron at the time of tapping.

Another fact confirmed by the present inventors is that the speed of erosion of the walls around the hearth is considerably influenced by the liquid permeabiliy of the core coke layer Co. This fact can be explained by way of the cross sections of the furnace bed portion shown in FIGS. 5 and 6. Namely, FIG. 5 shows the flow of pig iron being tapped in a case where the dead coke layer Co has good liquid permeability. In this case, the molten pig iron F flows toward the tap hole E from the entire hearth portion including the center of the dead-man, so that the peripheral walls of the hearth are unlikely to receive concentric erosive attacks. However, in a case where the dead coke layer Co has inferior liquid permeability with a great resistance to liquid flows in the dead-man or center core portion, the molten pig iron F to be tapped invariably forms peripheral streams as indicated by solid line arrow in FIG. 6 making considerable erosive attacks upon the peripheral walls of the hearth.

Based on the above-mentioned findings that the gas permeability and liquid permeability of the dead coke layer have great influences on the efficiency of the blast furnace operation and the erosive wear of peripheral walls of the furnace bottom, the present inventors continued their studies to utilize them for the imrovement of the operational efficiency. In the first place, in order to clarify the position of the furnace top portion at which the renewal of the dead coke is mainly effected by the freshly charged coke, the lowering condition of the coke was simulated by the use of a 1/37 scale full-round blast furnace model as schematically shown in FIG. 7.

In the above-mentioned simulation: (1) Sample coke was extracted at a predetermined speed through extraction ports Ex provided in positions corresponding to the tuyeres, simulate the combustive consumption of coke by hot blasts blown in through the tuyeres; and (2) The hearth of the furnace was constituted by a vertically movable round table which was lowered at a predetermined speed during the experiment to simulate the consumption (combustion, carburization and dissolution into the molten pig iron) of the dead coke Co in the experimentary furnace.

Figure 7:
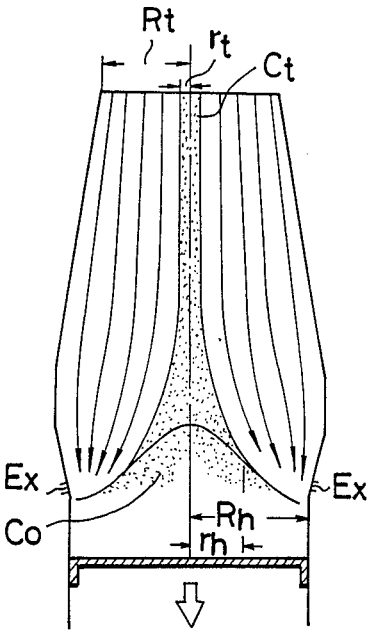
FIG. 7 is a schematic view of a furance of an experimentary simulation model, showing the condition of the lowering charged material.

The results of the experiment are also shown in FIG. 7. As seen therefrom, of the charged coke, the coke C which is charged on the outer peripheral side of a particular region of the centeral part of the furnace flows toward peripheral portions along the sloped side of the conical dead coke layer Co and consumed by combustion as mentioned in (1) above. On the other hand, the coke C which is charged to the particular region of the centeral part is lowered substantially vertically to form the dead coke layer Co. In an actual furnace, the dead coke layer Co is gradually consumed by combustion, carburization and dissolution into the molten pig iron, maintaining the equilibrium by the replenishing coke which comes down along the center axis. The time which is required to replace completely the dead coke layer Co, which exists at a certain time point, by freshly charged coke is normally 7 to 14 days although it depends upon the shape and operating conditions of the blast furnace.

Any way, the results shown in FIG. 7 elucidates the fact that the dead coke layer Co is renewed by the coke which is charged to a very restricted region of the centeral part of the furnace. This gives a guideline that the improvement of the gas and liquid permeability of the dead coke layer Co can be attained by reforming only the coke to be charged into the restricted region in the centeral part of the furnace.

Therefore, further studies were carried out to grip quantitatively the renewing condition of the dead coke layer Co by the coke which is charged to the center axis of the furnace (in some cases referred to as "centrally charging coke" hereinlater).

Figure 8:
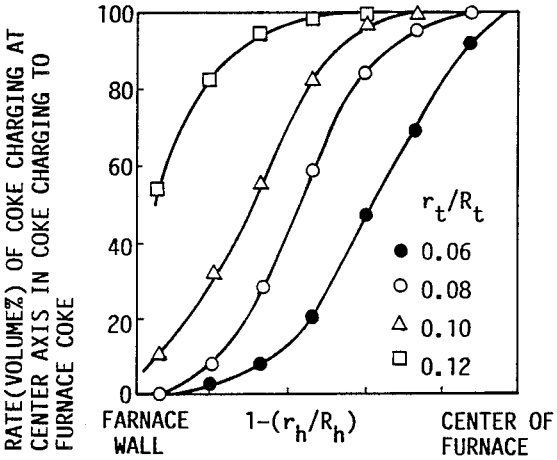
FIG. 8 is a diagram showing the relationship between the rate of the coke charge to the centeral part and drops in pressure loss in the lower furnace portion.

Referring to FIG. 8, there is shown the renewing condition of the dead coke layer Co by tracer coke (i.e., the distribution of concentration of tracer coke in the dead-man) in a number of cases where the tracer coke is charged as the centrally charging coke Ct fed to the center region where the non-dimensional radius ($r_t/R_t$ in which $r_t$ is an arbitrary radius from the center axis and $R_t$ is the radius of the furnace top) of the central part is 0.06, 0.08, 0.10 and 0.12, respectively. The region where the dead coke layer Co is renewed by the tracer coke is determined depending upon the tracer coke charging radius ($r_t/R_t$). When $r_t/R_t=0.12$, the concentration of the tracer coke becomes 100% in all regions except part of the peripheral portions of the hearth. From these results, it can be confirmed that the dead coke layer Co is gradually renewed by the coke which is charged to the center axis of the furnace top. Accordingly, it can be expected that the gas and air permeability of the dead coke layer Co can be adjusted by suitably controlling the grain size and the grain size distribution of the coke to be charted to the center axis of the furnace top or by adjusting its cold or hot strength or the like.

Figure 9:
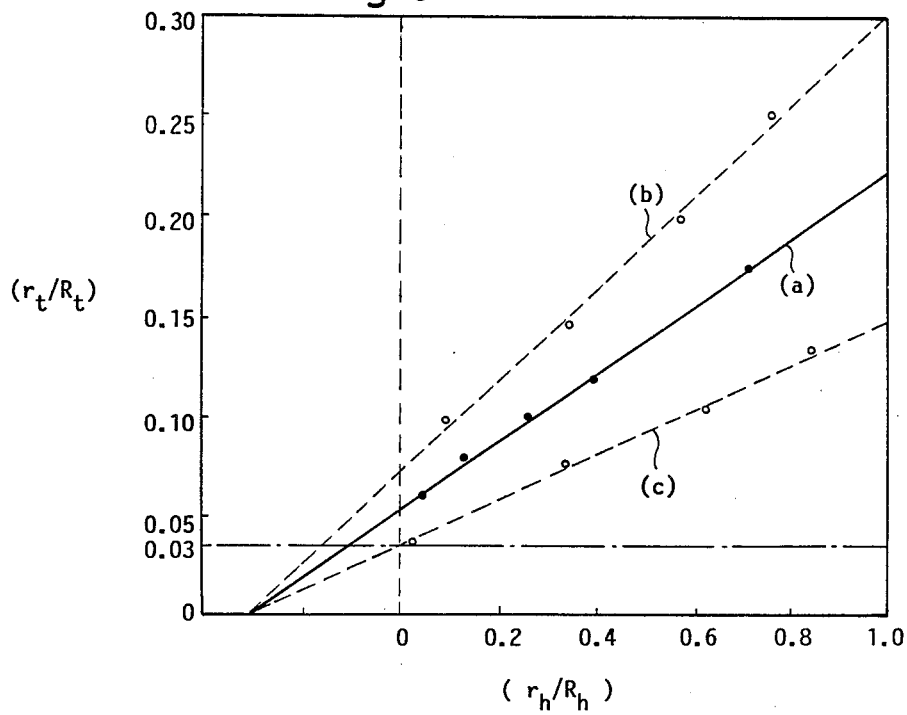
FIG. 9 is a diagram showing the relationship between $r_t/R_t$ and $r_h/R_h$ obtained by the simulation test.

The diagram of FIG. 9 shows the relationship of the charging radius ($r_t/R_t$) of the tracer coke at the center axis of the furnace top with the region ($r_h/R_h$ in which $r_h$ is the radius of the core coke layer Co renewed by the centrally charged coke, and $R_h$ is the radius of the furnace bed) which is renewed 100% by the tracer coke. The solid line (a) and the broken lines (b) and (c) represent the cases where the total renewal period of the dead coke in an actual furnace is assumed to be 10 day, 7 days and 14 days, respectively. From these results, it is possible to determine the relationship between $r_t/R_t$ and $r_h/R_h$ as expressed by the following equations (a) to (c) which correspond to the solid line (a) and broken lines (b) and (c) of FIG. 9, respectively.

$$(a)\ (r_t/R_t)=0.164(r_h/R_h)+0.052 \quad (a)$$
$$(b)\ (r_t/R_t)=0.227(r_h/R_h)+0.073 \quad (b)$$
$$(c)\ (r_t/R_t)=0.114(r_h/R_h)+0.036 \quad (c)$$

Accordingly, the dead coke layer Co can be renewed surely by the centrally charging coke Ct, by making settings such that the value of the left side will exceed the value of the right side in Equations (a) to (c) above, according to the desired period of renewal of the dead coke layer Co of the blast furnace, namely, by setting the radius of the centrally charging coke Ct such that $(r_t/R_t)$ will come above the lines (a), (b) or (c) in FIG. 9. Although the renewal period in an actual furnace is considered to fall normally in the range of 7 to 14 days in the foregoing description, the value of $r_t/R_t$ is determined to be $\geqq 0.03$, namely, $r_t \geqq 0.03R_t$ in the present invention, assuming that the renewal period may exceed 14 days or the value of $r_t/R_t$ may be below the line (3) of FIG. 9 depending upon the type or operating condition of the furnace.

As long as the 100% renewal of the dead coke layer by the centro-axially charged coke is concerned, it is preferred that the value of $r_t/R_t$ be as large as possible, and there is no necessity for setting an upper limit therefor. However, if that value becomes excessively large, most of the centroaxially charged coke, which is located on the peripheral side, is consumed by combustion as a result of the reaction with the hot blasts without being taken into the dead coke layer Co, wastefully increasing the consumption of coke of good quality. Therefore, from an economical point of view, it is preferred to set the value of $(r_t/R_t)$ at a level smaller than 0.3 $(r_t \leqq 0.3R_t)$.

The present inventors conducted further studies with regard to the admistrative factors for controlling the dead coke renewal efficiently, and confirmed that the pressue loss which is one of the administrative factors in the blast furnace operation is closely related with the gas and liquid permeability of the dead coke layer and that the objects of the invention can be achieved more effectively by controlling the amount of the centro-axial coke charging in relation with the value of the pressure loss.

Namely, when the blast furnace operation is maintained in stable state, the dead coke layer has good gas permeability, the climbing gas is dominated by centralized streams to hold the softened cohesive zone appropriately in inverted V-shape with a small pressure loss. As the gas permeability of the dead coke layer deteriorates, the proportion of peripheral streams in the climbing gas flow becomes greater, deforming the softened cohesive zone into W-shape which puts the furnace in instable condition. Such a furnace condition is immediately reflected not only by an increase of pressure loss but also marked fluctuations in pressure loss. It follows that the operating condition of the furnace can be maintained in stable state by constantly measuring the pressure loss or its fluctuations (differences between sequentially measured values of the constantly varying pressure loss) and controlling the centrally charging coke to an amount suitable for the enhancement of the gas permeability to restore the appropriate gas permeability of the dead coke layer.

Figure 10:
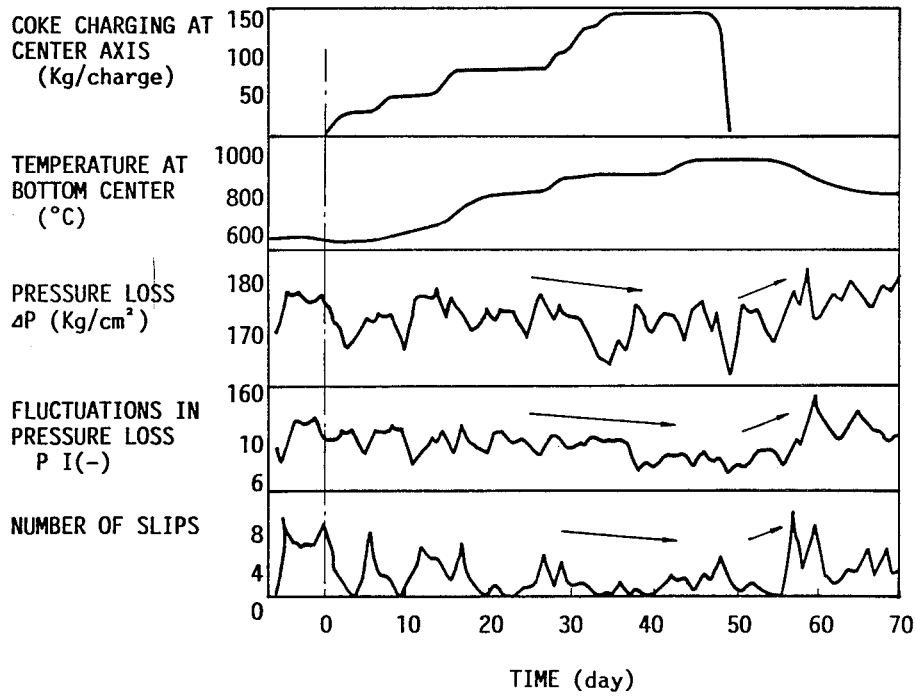
FIG. 10 is a diagram showing the results of experiments using an actual blast furnace.
Figure 11:
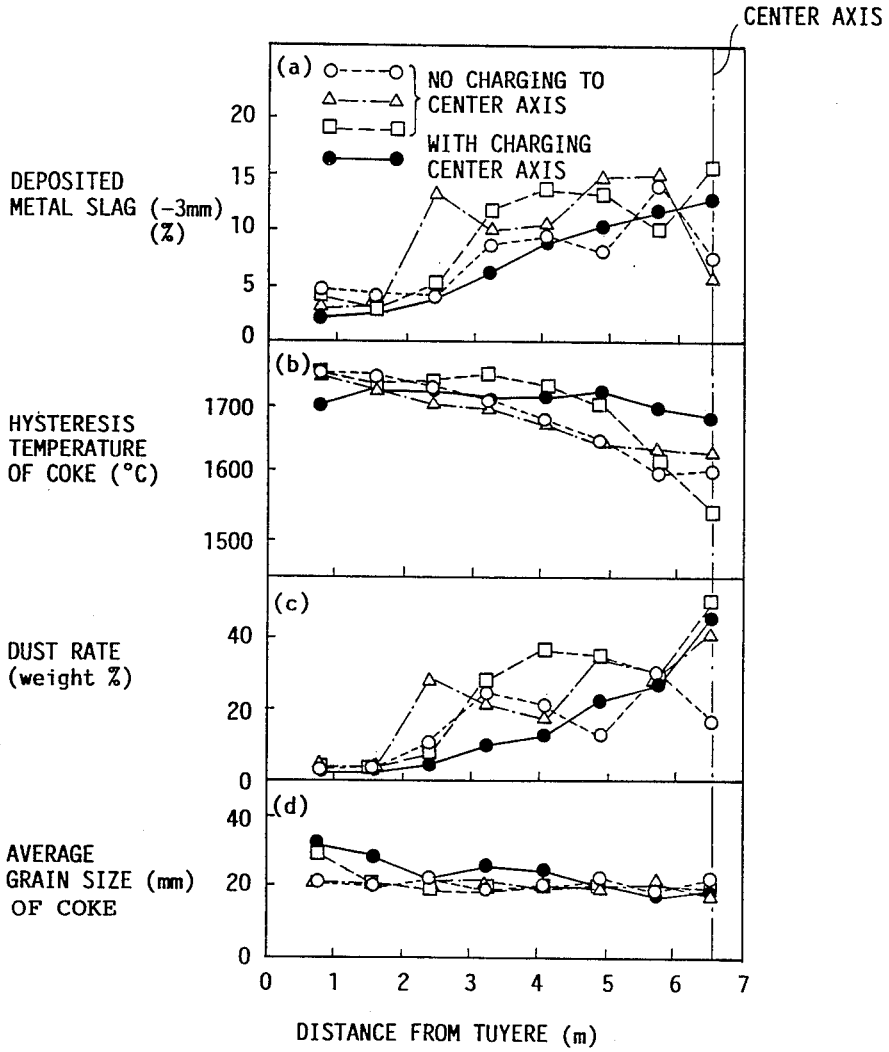
FIG. 11 is a diagram showing the particle size and dust rate of the core-filling coke existing in the radial direction of the furnace core at the end of the experiment.

By way of example, FIG. 10 shows the pressure loss (the difference between the blast pressure and the furnace top pressure) and its fluctuations along with the number of slips in an operation of an actual furnace in which tracer coke containing a marker was charged to the center position over a period of about 2 months (charging coke C to the centeral part of the furnace top prior to charging ore O by the method as will be described in greater detail hereinlater), while adjusting the hot blast feed pressure in such a manner as to maintain a constant furnace top pressure. It will be seen therefrom that, as the amount of center coke charging is increased, the pressure loss and fluctuations and the number of slips are reduced, indicating stabilization of the furnace condition. On the other hand, FIG. 11 shows the grain size of coke, its dust rate, the amount of deposited metal.slag and the hysteresis temperature of the coke, which were sampled at a number of positions in the radial direction of the dead-man of the furnace at the end of the just-mentioned operational experiment. It has been confirmed that, by adoption of the centro-axial coke charging method, the gas permeability of the furnace core portion is improved as a result of a reduction in the amount of the fine coke dust (the content of coke dust with a grain size smaller than 5 mm) in the intermediate portion (the intermediate portion between the center axis of the furnace and inner wall surface of the furnace) and an increase of the average grain size (the average diameter of coarse particles greater than 5 mm). Therefore, the hot blasts which are blown in through the raceway are expected to flow toward the center axis without stagnating in the peripheral portions of the dead-man.

Figure 12:
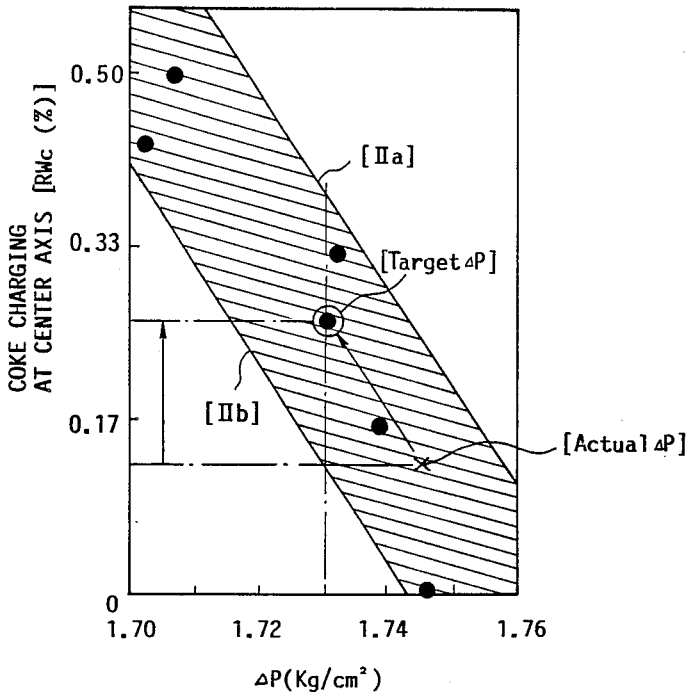
FIGS. 12 and 13 are diagrams showing the rate of the central coke charging in relation with the pressure loss ($\Delta P$) and fluctuations in pressure loss (P.I.), respectively.

The measured values of the pressure loss are processed as data for the furnace control. In this connection, FIG. 12 shows the relationship between the amount of coke charging to the center axis ($RW_c$) and the pressure loss $\Delta P$, obtained by compiling a large number of experimental data including those of the above-described experiments.

The pressure loss is sequentially measured during operation of the blast furnace. Since the measured values vary successively, their mean value which is calculated each day is normally called "pressure loss" but there are no restrictions in particular with regard to the time length for averaging the measured values. Besides, the mean value is not restricted to the simple mathematical calculation of averages, and may resort to a method in which certain corrective elements are added. As clear from this diagram, the furnace condition remains stable as long as the relationship between $RW_c$ and $\Delta P$ falls in the hatched range defined by the formulas IIa and IIb of FIG. 12 (corresponding to the equations IIa and IIb, namely, to the formula II below). It follows that $\Delta P$ can be controlled by adjusting $RW_c$ along the hatched area.

$$RW_c=-9.72\times\Delta P+17.20 \quad \text{IIa}$$

$$RW_c=-9.72\times\Delta P+16.93 \quad \text{IIb}$$

$$(-9.72\times\Delta P+16.93)<RW_c<(-9.72\times\Delta P+17.2) \quad \text{II}$$

More specifically, the relationship between $RW_c$ and $\Delta P$ is determined prior to a blast furnace operation as shown in FIG. 12. Upon starting the operation, the pressure loss is measured as "actual $\Delta P$" sequentially or periodically. When it is desired to change the pressure loss, the pressure loss to be attained by adjustment is set as "target $\Delta P$", and the value of $RW_c$ corresponding to the "target $\Delta P$" is determined from the angle of inclination $\theta$ of the hatched area in FIG. 12 and the "target $\Delta P$", thereby controlling the rate of the center charging coke.

Described below is an example for sequentially processing the measured values of the pressure loss which varies momentarily.

Figure 13:
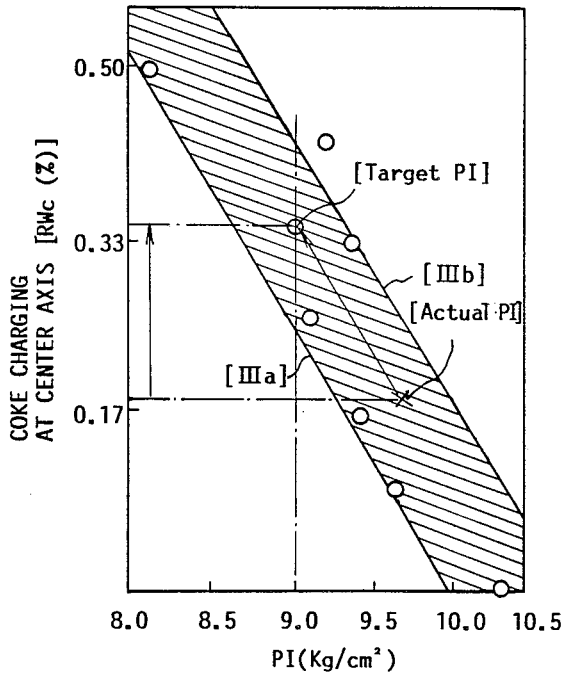

The diagram of FIG. 13 shows the relationship with the pressure loss PI, complied from a large number of experimental data including the above-described experiments. As clear from this diagram, the furnace condition remains stable as long as the relationship between the weight ratio $RW_c$ of the coke charging to the center axis and PI falls in the hatched area defined by formulas IIIa and IIIb of FIG. 13 (corresponding to Equations IIIa and IIIb, namely, to Formula III given below).

$$RW_c = -0.263 \times PI + 2.63 \quad \text{IIIa}$$

$$RW_c = -0.263 \times PI + 2.83 \quad \text{IIIb}$$

$$-0.263 \times PI \leqq RW_c \leqq -0.263 \times PI + 2.63 \quad \text{III}$$

Accordingly, prior to a blast furnace operation, the relationship between $RW_c$ and PI is determined as shown in FIG. 13, and, upon starting the operation, variations in the pressure loss are measured sequentially or periodically as "actual pressure loss variation PI". When it is desired to alter the pressure loss variation, the pressure loss variation to be attained by adjustment is set as "target pressure loss variation PI", and the value of $RW_c$ corresponding to the "target PI" is determined from the above-mentioned "actual PI", the angle of inclination $\theta$ of the hatched area of FIG. 13 and the "target PI", thereby controlling the rate of the center charging coke.

As a fluctuation or variation in pressure loss, it is the general method to employ a mean value which is obtained by comparing and determining the differences between the absolute values of the sequentially measured pressure losses and dividing the sum of the differences by the number of data. The formula for this calculation is given below.

$$PI = \{\Sigma(|\Delta P_{i-1} - \Delta P_1|\}/n$$

$\Delta P$: Pressure loss (kg/cm$^2$)

n: Number of measurements per unit time

However, for obtaining the mean value, it is possible to employ the weighted mean or to resort to other methods including the methods introducing various corrections. In this regard, it is to be noted that the present invention is not restricted any particular method of determining mean values.

Figure 6:
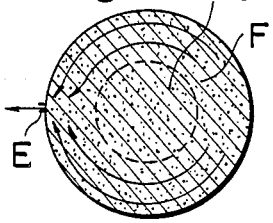

By setting the amount and radius of the coke charging to the center axis in compliance with the above-discussed conditions, the gas permeability of the dead coke layer can be improved as described hereinbefore, urging the climbing furnace gas to form centralized streams to maintain favorable furnace condition, and at the same time the dead coke layer can retain good liquid permeability, permitting the molten pig iron and slag on the hearth to flow smoothly toward the tap hole E from everywhere on the whole furnace bed portion as shown in FIG. 5 to preclude concentrated erosive attacks on the peripheral walls of the hearth. In this connection, it has been confirmed by the inventors that, when the dead coke layer has good liquid permeability and the molten iron and slag at the bottom of the furnace are allowed to flow toward the tap hole E from entire areas of the hearth as shown in FIG. 5, the temperature at the center of the hearth is elevated under its influence, and that, when the dead coke layer has inferior liquid permeability and the molten iron and slag form peripheral streams as shown in FIG. 6, the temperature at the center of the hearth becomes lower. This means that the liquid permeability of the core coke layer can be estimated from the temperature at the center of the hearth. Therefore, the following experiments were conducted on the assumption that variations in that temperature would be useful as an admistrative factor for controlling appropriately the amount of coke charging to the center axis. Namely, a survey was made with regard to the relationship between the weight ratio $RW_c$ of the centro-axial coke charging and the hearth temperature variation $\Delta T/Ts$, which produces desirable flow conditions of the molten pig iron and slag. Here, Ts is the mean temperature at the center axis of the hearth in operation without the centro-axial coke charging, and $\Delta T$ is the difference from Ts of the furnace bottom temperature in operation with the centro-axial charging of the solid reducing agent.

Figure 14:
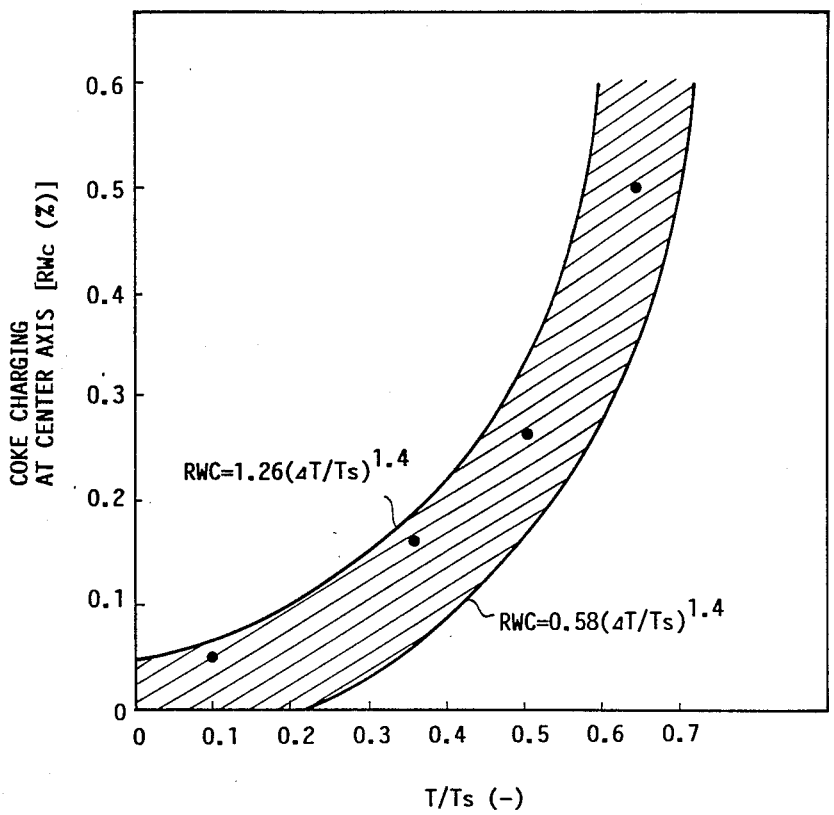
FIG. 14 is a diagram showing the relationship between the rate of the central coke charging and temperature variations ($\Delta T/Ts$) at the center of the hearth.

The results are shown in FIG. 14, in which the relationship between them is expressed by way of exponential function. The data of the actual furnace existed in the area defined by the following formulas IVa and IVb (in the hatched area in FIG. 14).

$$RW_c = 1.26\ (\Delta T/Ts)^{1.4} \quad \text{IVa}$$

$$RW_c = 0.58\ (\Delta T/Ts)^{1.4} \quad \text{IVb}$$

Namely, the flow condition of the molten pig iron and slag, which have dropped on the hearth and move toward the tap hole, can be controlled to flow into the tap hole mostly through a center portion of the hearth by controlling the relationshiop between the weight ratio $RW_c$ of the centro-axially charging coke and the hearth temperature variation $\Delta T/Ts$ to satisfy the condition of the following Formula IV.

$$0.58\ (\Delta T/Ts)^{1.4} < RW_c < 1.26(\Delta T/Ts)^{1.4} \quad \text{IV}$$

To give an example of application of this method, it is possible to regulate the variations in the hearth temperature by adjusting the properties (e.g., grain size distribution, cold strength, hot strength etc.) of the coke to be charged to the center axis of the furnace.

Figure 15A:
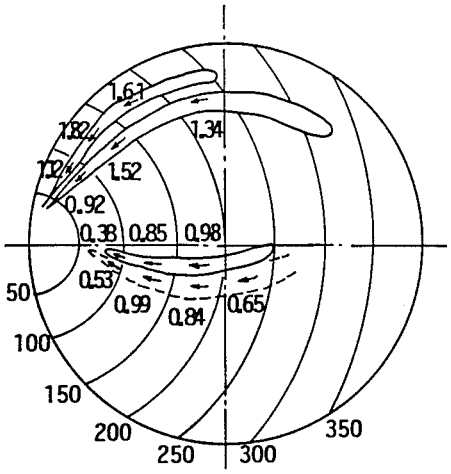
FIGS. 15(A) and 15(B) are diagrammatic illustrations of the velocity distribution of the fluid on the furnace hearth at the time of tapping in the simulation test.
Figure 15B:
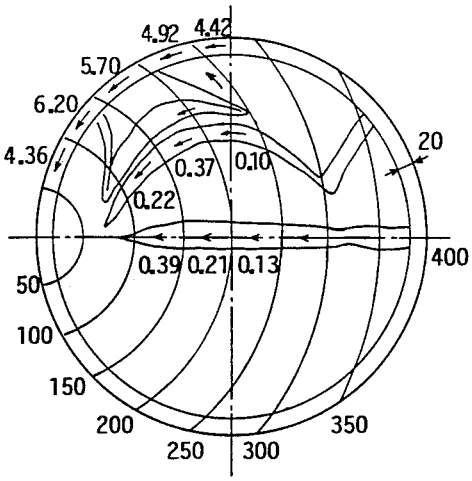
Figure 16:
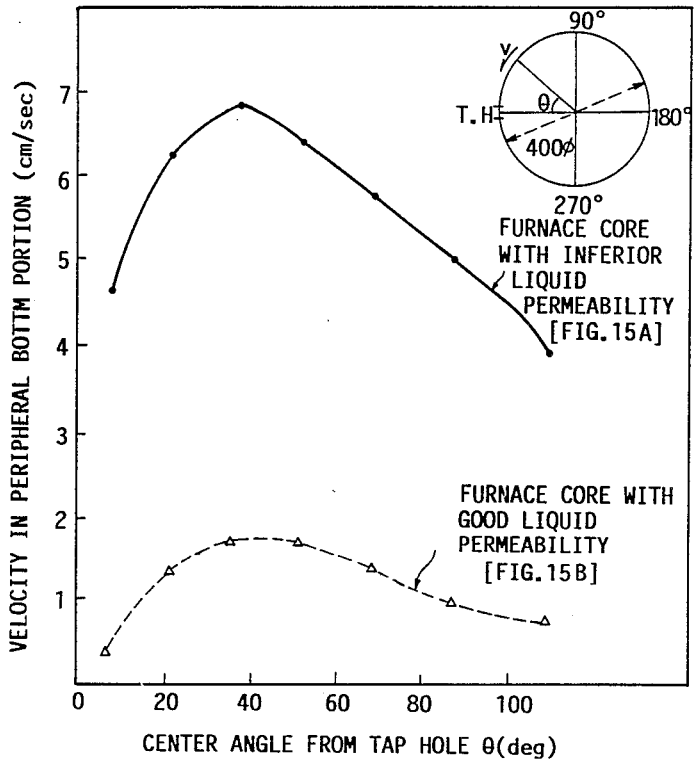
FIG. 16 is a diagram showing the relationship between the center angle $\theta$ from the tap hole and the velocity along the hearth of the furnace.

FIGS. 15 and 16 show the results of simulative experiments using a liquid to inspect the flow patterns of the liquid being discharged through the tap hole in bottom portions of furnaces with cores of good and inferior liquid permeability. In a case where the centro-axial coke charging according to the invention is not effected and the dead coke layer has inferior liquid permeability (FIGS. 15(A) and FIG. 16), the liquid forms rapid circular flows along peripheral portions of the hearth. In contrast, in a case where the centro-axial coke charging according to the invention is effected to improve the liquid permeability of the dead coke layer of the furnace (FIG. 15(B) and FIG. 16), the liquid shows a flow pattern in which it flows toward the tap hole uniformly from the entire area of the hearth including its center portion (which means that the velocity of the circular flows along the peripheral portions of the hearth is lowered).

Thus, by feeding coke of appropriate grain size and good cold and hot crushing strength (i.e., suitable for the improvement of the liquid permeability) to the center axis of the furnace in the amount and charging radius satisfying the above-described conditions, the dead coke layer is occupied by coke of good quality, and the climbing furnace gas forms centralized streams as described hereinbefore in connection with FIG. 3 to maintain the softened cohesive zone stably in inverted V-shape. In addition to the high production efficiency, this contributes to prevent erosive losses of peripheral walls around the hearth since at the time of tapping the molten iron flows toward the tap hole uniformly from all directions through the furnace bed portions as explained hereinbefore with reference to FIG. 5.

Besides, the adoption of the above-described operating method facilitates the formation of centralized streams of the climbing furnace gas, and lowers the O/C ratio in the center portion, reducing the heat consumption for the reducing reaction while elevating the temperature at the centeral part of the furnace. As a result, condensation of low melting point metals at and around the centeral part of the furnace is suppressed, and the circulating substances including these low melting point metals are entrained on the strong centralized gas streams and discharged from the furnace, precluding the problems which would otherwise be caused by accumulation of the low melting point metals.

Figure 17:
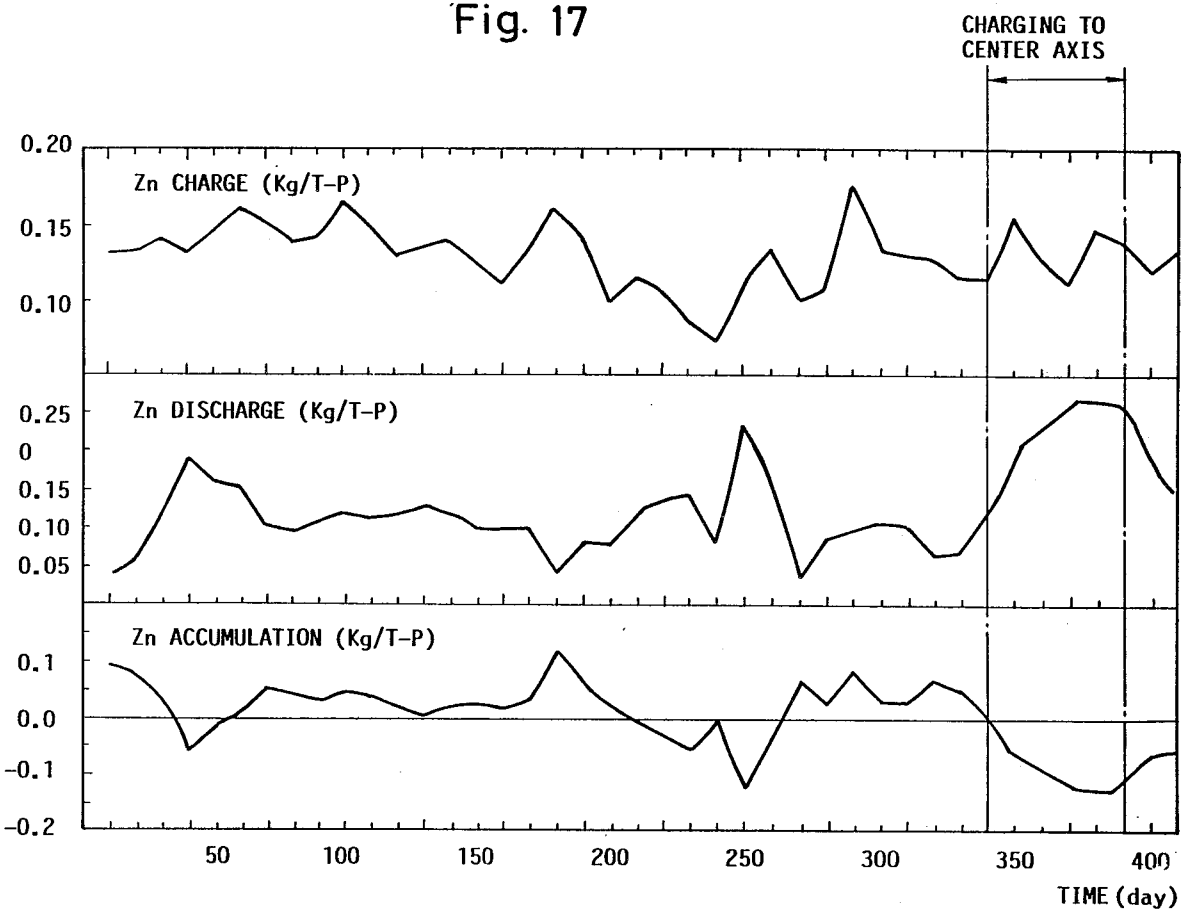
FIG. 17 is a diagram showing variations in the amounts of Zn charging, Zn discharging and Zn accumulation in the furnace in an actual flast furnace operation.

For instance, FIG. 17 shows the results of an operation of an actual blast furnace, tracing variations in the amounts of Zn charging, Zn discharge and Zn accumulation. As clear therefrom, when coke charged to the center axis according to the invention, the amount of Zn discharge is increased to a marked degree, as a result reducing the Zn accumulation considerably.

In the foregoing description, it is explained that coke of good quality is used for the center coke charging. This means that the coke to be charged into the peripheral portions of the furnace suffices to be of universal type. A method of separately charging quality coke and ordinary coke is now explained by way of two examples (FIGS. 18 and 19).

Figure 18A:
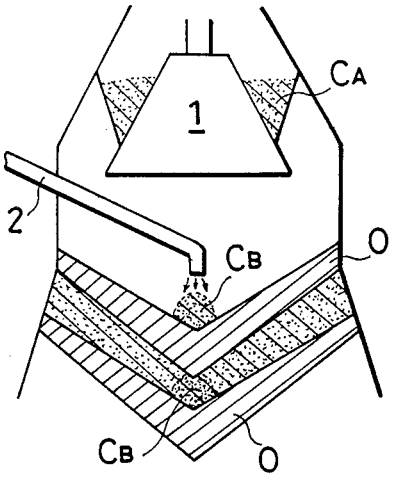
FIGS. 18(A), 18(B), 19(A) and 19(B) are schematic sectional views explanatory of the material charging methods adopted in the present invention.
Figure 18B:
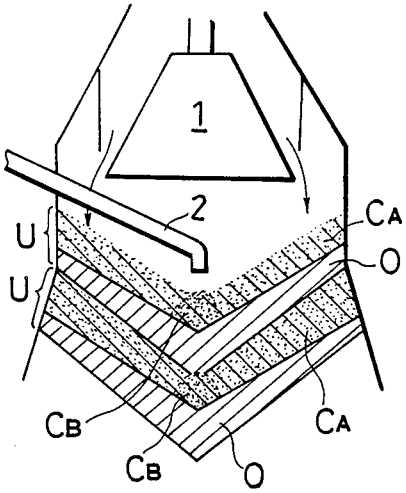
Figure 19A:
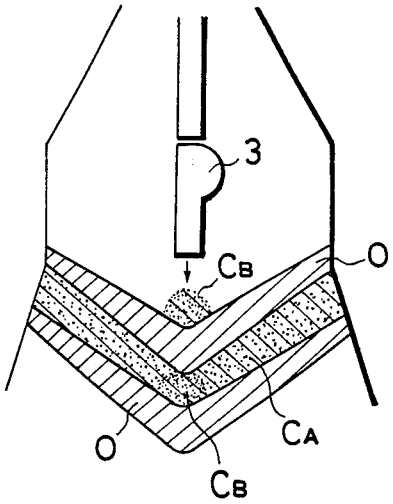
Figure 19B:
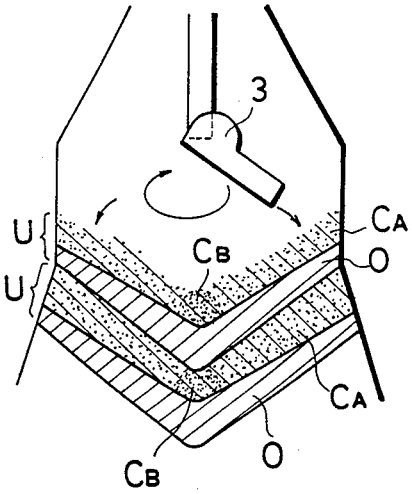

Referring to FIGS. 18(A) and 18(B), there is shown in vertical section the top portion of a bell type blast furnace, a chute 2 for charging quality coke toward the center axis of the furnace is provided separately from a material charging bell 1. A suitable amount of quality coke $C_B$ is charged to the center axis of the furnace top prior to charging ordinary coke $C_A$ (FIG. 18(A)), and then ordinary coke $C_A$ is charged into the peripheral portions from the bell 1 (FIG. 18(B)). The ordinary coke $C_A$ which is charged later is stopped by the quality coke $C_B$ and therefore unable to fall into the centero-axial portion. It follows that the center axis of the furnace is occupied by the quality coke. Shown in FIGS. 19(A) and 19(B) is a bell-less type blast furnace which is provided with a rotary distributor chute 3. Firstly, the distributor chute 3 is directed straight downward to charge a suitable amount of quality coke $C_B$ to the center axis portion (FIG. 19(A)), and then turned to a slant position (turned toward the furnace wall) and rotated to charge ordinary coke $C_A$ around the periphery of the precharged quality coke (FIG. 19(B)).

In the foregoing description, the charging area of the center charging coke was determined on the assumption that the dead coke layer Co would be renewed 100% by quality coke with respect to each one of the coke layers in the central portion of the furnace as shown in FIGS. 18(B) and 19(B). However, actually all of the dead coke layers Co are not necessarily required to be renewed by quality coke of the nature suitable for improvement of the gas and liquid permeability. Accordingly, it was considered that suitable gas and liquid permeability of the dead coke layer Co would be maintained by controlling the charging of quality coke in such a manner as to occupy constantly more than a certain proportion of the dead coke layer Co. As a result of further experiments conducted from this viewpoint, it has been found that a dead coke layer with gas and liquid permeability conforming with the objects of the invention could be secured by adjusting the amount of center charging in such a manner that the quality coke would occupy the dead coke layer Co in a proportion greater than 5 wt %. It has also been found that the quality coke could be adjusted to such a proportion by charging the quality coke, contributing to the improvement of the gas and liquid permeability, to the center region defined by Formula I and in an amount in excess of 0.2 wt % of the total amount of coke charging to the furnace.

Figure 20:
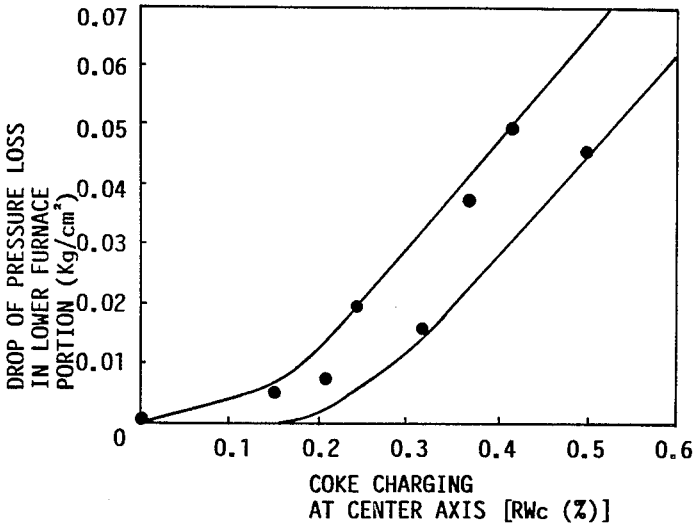
FIG. 20 is a diagram showing the relationship between the amount of coke charging to the center position and drops of pressure loss in the lower furnace portion.

Referring to FIG. 20, there are shown the relationship between the weight ratio of center charging coke $RW_c$ and the drop of the pressure loss in the lower furnace portion in an operation of a blast furnace with separate coke charges to the furnace top. As clear therefrom, the pressure loss in the lower furnace portion drops as the weight ratio $RW_c$ of the centro-axial coke charging is increased, starting from the vicinity of a coke charging amount of about 0.2%. Namely, suitable gas permeability of the lower furnace portion (including the dead coke layer) can be maintained by charging quality coke to the center axis of the furnace top in an amount of about 0.2% of the total coke charge.

Accordingly, as shown in FIGS. 18 and 19, it is not necessarily required to charge the quality coke to the center axis against each one of the coke charges (1 charge means the unit charge indicated by U in FIGS. 19(A) and 19(B), namely, the basic unit of charge consisting of a coke layer and an ore layer in overlapped state). That is to say, it is of course possible to employ a method of varying the mixing ratio of centro-axially charging coke consisting of a mixture of ordinary coke and quality coke, or a method of effecting the centro-axial charging of quality coke selectively in every 2 to 5 charges or selectively at a particular batch of each charge which is divided into a number of batches.

By this method, the amount of quality coke $C_B$ to be charged to the centro-axial charging area of the radius explained hereinbefore with reference to FIGS. 7 and 8 is controlled to 0.2 wt % of the total amount of coke charging. The quality coke which exists in a suitable proportion in the core portion of the furnace is lowered and used for renewal of the dead coke layer Co to ensure excellent gas and liquid permeability thereof.

Although quality coke is charged to the center axis of the coke layer in the foregoing description, it has been confirmed that similar effects can be obtained by charging ordinary coke $C_A$ alone to the coke layer while charging quality coke to the center axis of the ore layer. In this method, the ordinary coke in the furnace core has effects similar to the quality coke.

Figure 21A:
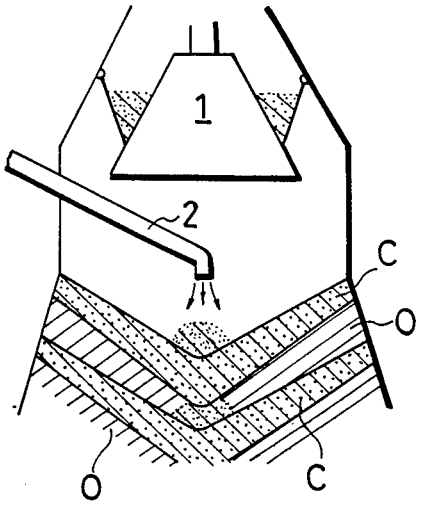
FIGS. 21(A) and 21(B) are schematic sectional views explanatory of another material charging method employed in the present invention.
Figure 21B:
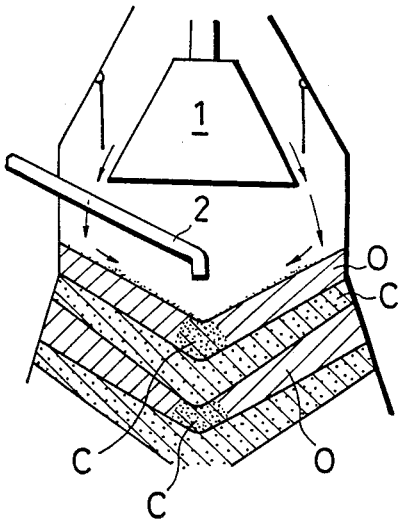

Referring to FIGS. 21(A) and 21(B) which show a bell type blast furnace similarly to FIGS. 18(A) and 18(B), a chute 4 which charges coke C to the center axis of the furnace top is provided separately from the material charging bell 1. The coke layer C is formed by one and single charge (or batchwise). Upon forming an ore layer O thereon, a predetermined amount of coke C is charged to the center axis of the furnace top through the chute 4 (FIG. 21(A)) prior to charging ore O, and then ore O is charged around the coke C from the bell 1 (FIG. 21(B)). By so doing, the centeral part of the furnace top, which is occupied by the coke C, acts as a weir to block flows of ore O into the centeral part. As a result, the ore O and coke C form alternate layers in the peripheral portions of the furnace around the core portion which substantially consists of a columnar layer of coke C alone.

In a blast furnace, CO-containing reducing gas which is produced by reaction between the hot blasts blown in through the tuyeres and the coke flows upward in contact with the iron ore, which as a result undergoes the folllowing reducing reactions.

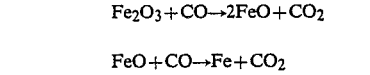

$$Fe_2O_3+CO \rightarrow 2FeO+CO_2$$

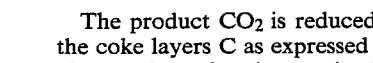

$$FeO+CO \rightarrow Fe+CO_2$$

The product $CO_2$ is reduced as it is passed through the coke layers C as expressed by the reaction formula given below, forming again CO-containing reducing gas for reducing reaction with iron ore in upper layers.

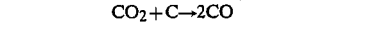

$$CO_2+C \rightarrow 2CO$$

Accordingly, the coke grains in the respective coke layers gradually lose their volumes from respective surfaces and become finer particles by reaction with $CO_2$ which is produced during passage through the immediately underlying ore layer O (solution loss reaction). However, when the center axis portion is filled with coke C alone by the method as shown in FIGS. 21(A) and 21(B), the climbing gas which flows through the central axis part is kept from contact with the ore and therefore from oxidation, climbing in the state of the reducing CO gas. Consequently, the coke in the central part is unlikely to diminish finer particles by the solution 1 oss reaction ($CO_2+C \rightarrow 2CO$), and even ordinary coke which ret ains the form of coarse grains reneews the dead coke layer Co, maintaining the excellent gas and liquid permeability of the core coke layer in the same manner as described hereinbefore.

This method (hereinafter may be referred to as "ore layer reforming method") improves the properties of the core coke layer Co by suppressing reduction of the coke grain size while lowering in the central part of the furnace. As compared with the above-described "core coke layer reforming" method, this method is economical as it can achieve the objects without using quality coke. However, even in a case where the ore layer reforming method is applied, it is preferred to use quality coke for all or part of the coke to be charged from the furnace top to the centeral part of the ore layer to prevent diminution of the grain size in the lowering movement under the pressure of accumulation as well as deteriorations of the gas and liquid permeability of the dead coke zone more securely. When the ore layer reforming method is put into practice, there is no need to effect the centro-axial charging for each charge or each batch since it suffices to effect it at intervals of a predetermined number of batches or charges similarly to the above-described coke layer reforming method. Needless to say, a combination of the coke layer reforming method and the ore layer reforming method is encompassed by the technical scope of the invention.

A typical example of the solid reducing agent which is useful in the present invention as the dead-man constituent to be formed by the central charging is quality coke with high hot and cold crush strength and a controlled grain size. However, instead of quality coke or in combination with quality coke, there may be employed other carbonaceous materials such as silicon carbide bricks, graphite bricks, charcoal or the like which are adjusted to a suitable grain size prior to the centro-axial charging.

In the examples of charging shown in FIGS. 18, 19 and 21, ordinary charging materials except the centro-axial charging material are all fed to the peripheral portions from the furnace top wall, packing the charged materials toward the center axis by the flow movements of the materials themselves to present V-shape in packed state. However, of course the packing shape at the time of charging to the furnace top is not limited to the V-shape, and it is also possible to adopt a method of shifting the charging position gradully from the center axis toward the furnace wall by the use of a rotary distributor chute to heap the materials substantially horizontally.

Given below are the results of operational experiments using an actual furnace.

Tracer coke containing a marker was charged to the centeral part of the furnace top over a period of about 2 months, while sampling coke above the tuyere to examine in what proportion the tracer coke contributed to the renewal of the dead coke zone. The tracer coke charge to the central part of the furnace top was increased stepwise, and held at a constant level of 150 kg/charge from two weeks before the sampling in consideration of the total renewal period of the dead coke zone Co, the heap zone ($r_t/R_t$) of the tracer coke at the center of the furnace top being about 0.06 and the tracer coke concentration at the center of the furnace top receiving the tracer coke at a rate of 150 Kg/charge being 18%.

Figure 22:
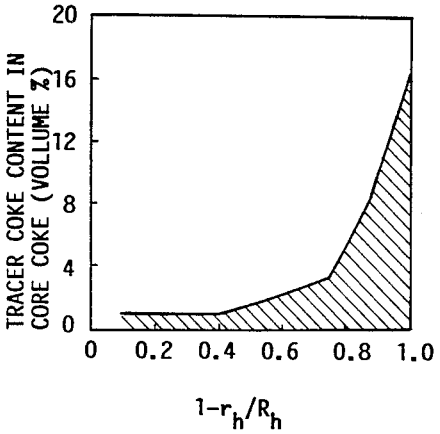
FIG. 22 is a diagram showing variations in the amount of the coke charge to the center axis (the tracer coke amount) measured in the axial direction of the dead coke layer in an actual blast furnace operation according to the method of the invention.

Shown in FIG. 22 are the results of the foregoing experiment, plotting the distribution of the tracer coke concentration in the dead coke zone. As clear therefrom, the region with a tracer coke cencentration of 18% is very small since the tracer coke is charged to the central part of the furnace top in an extremely small amount, but the shape of distribution of concentration is very similar to the results of the experiment shown in FIG. 11 (especially in dust rate). This confirms that the properties of the dead coke zone can be controlled by adjusting the amount of coke charging to the center of the furnace top.

Figure 23:
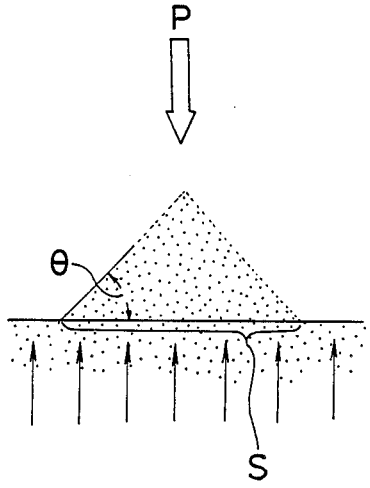
FIG. 23 is a schematic illustration explanatory of the general piled condition of particulate material.

When charging a specific raw material to a particular region at the center of a blast furnace as described above, it is desirable to adjust appropriately the relationship between the average gas velocity ($U_t$) in the furnace top portion and the gas velocity ($U_{mf}$) which initiates fluidization of the centrally charged material (coke). Namely, when particulate material is locally charged on the surface of a heaped layer (filled layer) through which the climbing gas flows, the particulate material P is generally heaped in a conical shape as shown by way of exampel in FIG. 23, with an angle of inclination $\theta$ depending upon the climbing gas velocity. With a greater gas velocity, the angle of inclination $\theta$ becomes smaller since the dropped particulate material is pushed back and spread by a greater lifting force of the climbing gas, increasing the depositing area S. In this connection, it is known that the angle of inclination of the heaped layer of particulate material relative to the velocity of climbing gas can be expressed readily by ($U/U_{mf}$), a ratio of the gas velocity (U) to the minimum fluidizing gas velocity ($U_{mf}$: the minimum gas velocity at which the particulate material becomes fluidized when a particular gas is used), the heap area S being broadened as the ratio ($U/U_{mf}$) becomes greater.

Figure 24:
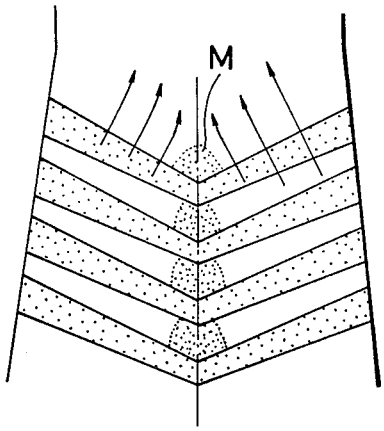
FIG. 24 is a vertically sectioned schematic view of a blast furnace, showing the climbing gas streams in the furnace and the piled condition of the charged material.

However, studies on the heap condition of the centrally charged material of blast furnace revealed the following. Generally, the surface of the heaped material layer is in the form of an inverted cone shape with its bottom at the center of the furrnace, and therefore the centrally charged material is dropped on the bottom portion in the shape of an upset cup (see FIG. 24).

Figure 25:
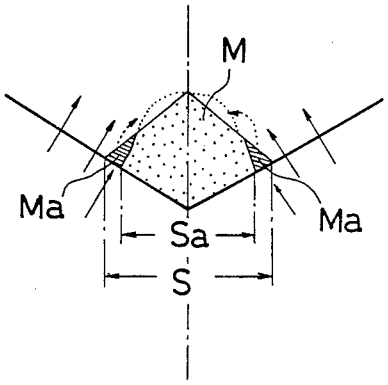
FIG. 25 is a schematic illustration showing the relationship between the preferred piled condition of coke charged to the center axis according to the invention and the climbing gas streams.

Further, the climbing gas in the furnace generally tends to flow out perpendicularly to the surface of the heaped layer as indicated by solid line arrow in FIG. 21, and the gas flows above the heaped layer are concentrated toward the center of the furnace. If the material is charged in the above-described shape in a furnace with such gas flows, dispersion of the dropped material is suppressed by the force which actson the dropped material in the direction toward the center of the furnace. In addition, as shown schematically in FIG. 25, the peripheral portions Ma of centrally charged material M, which are deposited in a smaller thickness, are lifted up by the vertically blowing climbing gas and heaped on the material M in a position closer to the center axis as indicated by broken line. As a result, the width of deposition of the centrally charged material is reduced from S to Sa of FIG. 25, concentrating the deposition of the material M to a narrow region in the central part.

As a result of studies on the conditions which would bring about the phenomenon of such concentrated deposition, it has been revealed that, as defined by Formula V given hereinbefore, the value of $U_t$ and/or $U_{mf}$ should be controlled in such a manner as to hold the ratio of the average gas velocity ($U_t$) in the furnace top portion and the gas velocity ($U_{mf}$) which initiates fluidization of the centrally charged material, $U_t/U_{mf}$, in the range of 0.30–0.52. In this instance, the value $U_t$ is adjusted by increasing or reducing the blast pressure from the tuyeres of the furnace, while the value $U_{mf}$ which varies depending upon the grain size, grain size distribution, grain shape, density and amount of continuous pores of the centrally charged material is adusted suitably by varying these properties of the material.

Figure 26:
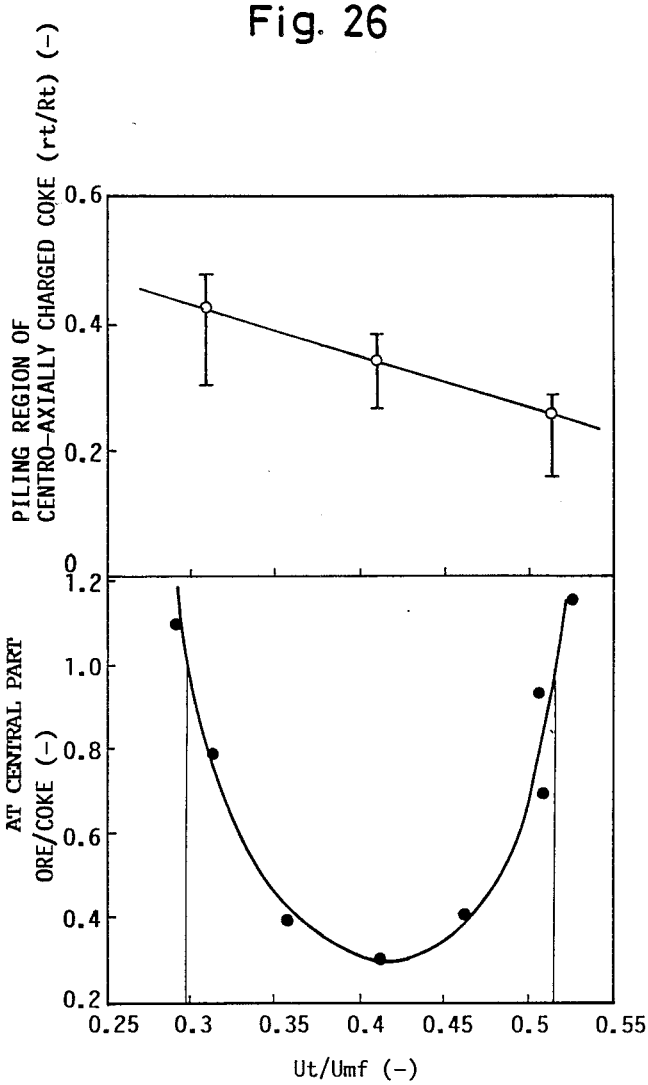
FIG. 26 is a diagram showing the influence of the ratio $U_t/U_{mf}$ on the piling region of the centrally charged coke and on the ratio of ore/coke.

Referring to FIG. 26, there is shown the relationship of the ratio $U_t/U_{mf}$ with the depositing region ($r_t/R_t$) of centrally charged coke and the ore to coke ratio (O/C) in an operation of actual blast furnace with center coke charging, employing the method of charging coke to the center axis prior to ore charging in charging and depositing an ore layer on top of a coke layer, and a method of making the central part coke-rich or 100% coke to prevent solution loss of the coke ($CO_2+C \rightarrow 2CO$) and at the same time to maintain the gas (and liquid) permeabilities of the central part of the furnace and the dead coke zone (see the afore-mentioned Patent Application (1) for details).

As seen therefrom, increases of the ratio $U_t/U_{mf}$ clearly grives rise to a trend of diminishing the depositing region of the centrally charged coke, enhancing the effect of concentrative deposition in the central part. On the other hand, the ratio O/C decreases abruptly as the value of $U_t/U_{mf}$ is increased up to about 0.4, reducing the amount of ore (of the previously charged ore layer) which mixes into the centrally charged coke. However, when the value of $U_t/U_{mf}$ exceeds about 0.4, the ratio O/C is increased abruptly. This is considered to be attributable to a phenomenon that the value of $U_t$, namely, the velocity of the climbing gas in the furnace is increased excessively as compared with the value of $U_{mf}$, vigorously fluidizing the peripheral portions of the centrally charged coke layer, entraining the dropped ore therein.

Figure 27:
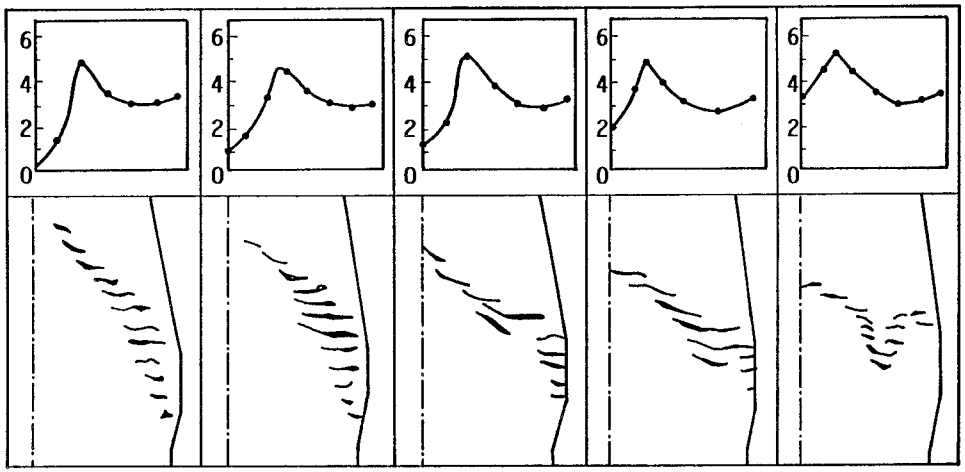
FIG. 27 is a diagram showing the results of experiments with respect to the influence of the ratio of ore/coke and the gas permeability distribution on the shape of the softened cohesive zone.

Shown in FIG. 27 is the results of experiments using an actual furnace and varying the ratio O/C of the central part to study variations in shape of the softened cohesive zone. As seen therefrom, the softened cohesive zone retains appropriately the inverted V-shape when the ratio O/C of the central part is in the range smaller than about 1.0. It is also known from these experimental results that the ratio O/C should be be smaller than about 1.0 and, when this is applied to FIG. 28, the appropriate range of the ratio $U_t/U_{mf}$ is 0.3 to 0.52.

In accordance with the present invention with the above-described configuration, a solid reducing agent of good quality is charged to a specific region at the center of a furnace top in an amount greater than a specific value or the amount of ore charge is reduced to suppress diminution of grain size during descendance, maintaining favorable gas and liquid permeability of the solid reducing agent in the central dead zone to hold the blast furnace operation in stable state and to secure high production efficiency, while contributing to prolong the service life of the furnace by suppressing erosive wear of peripheral walls of the furnace bottom.

Further, the present invention, which is capable of appropriately maintaining and controlling the gas and liquid permeability of the dead-man of blast furnace, has a number of advantageous side effects which enhance the economy and flexibility of the furnace operation. For instance, in a case where a large amount of finely grained coal is blown in from the tuyeres of the furnace, even if unburned fine coal accumulates in the furnace in a large amount, the combined use of the center coke charging makes it possible to maintain and control suitably the gas and liquid permeability of the dead-man or dead coke zone, suppressing or preventing the slips and hanging which have thus far been experienced due to increases of the pressure loss, variations of the molten iron temperature or localized gas flows, and thus permitting to blow in a larger amount of fine grain coal. Further, since the amount of centralized gas flows as well as the gas and liquid permeability of the dead coke zone can be controlled arbitrarily, it becomes possible to reduce the amount of coke charging to peripheral portion of the furnace top or to increase the amount of ore charging to achieve economical blast furnace operation.

On the other hand, the present invention allows an extremely broadened freedom in selecting the charging material. For example, in a case where pellets are mixed in a large proportion, the rest angle of the ore becomes smaller, so that a large amount of ore flows into and accumulate in the center portion of the furnace top when charged, lowering the gas flow rate in the central part. Therefore, it has been compelled to limit the amount of pellets to maintain the stability of balst furnace. However, the combined use of the central coke charging lowers the amount of ore accumulation in the central part locally or over the entire area of the furnace, making it possible to maintain stable gas flow rate in the central part even when pellets are mixed in a large proportion. This invention provides means which is extremely effective for operations using a large amount of pellets. Not only for a case simply using a large amount of pellets, the center charging of an adjusted amount of coke is effective but also for maintaing stable blast furnace operation in a case using various ore materials in arbitrary proportions, drastically broadening the freedom of ore material selection.

Moreover, the present invention is effective for supressing accumulation of Zn and alkali metals in blast furnace and for discharging them from the furnace. The temperature of the central part is elevated by center charging of a large amount of coke which develops gas flows in the central part, thereby preventing flocculation (solidification) of low melting point metals or gasifying the solidified low melting point metals in the center region to discharge them from the furnace in gaseous state. Namely, this invention can contribute to prevent fluctuations of gas flows in blast furnace, production of deposits on furnace walls or hanging which would be caused by cohesion of low melting point metals.

What is claimed is:

1. In a process for operating a blast furnace wherein charges of solid reducing agent and ore are repeatedly added to said furnace through an opening in the top of said furnace, the furnace having a central axis extending through said opening to the hearth of said furnace, the improvement comprising:

adding said solid reducing agent such that the portion of the solid reducing agent added through an area defined by a circle having the central axis as its center and a radius of 0.03 times the radius of said opening (said portion being termed the central charge), is greater than 0.2% (by weight) of the total solid reducing agent added at any one charging step.

2. The process of claim 1, wherein blast pressure lost (P) during operation of said blast furnace is monitored, and said central charge is such that the inequality $(-9.72)\ (\Delta P)+16.93<RWc<(-9.72)\ (\Delta P)+17.2$ is satisfied wherein RWc is the central charge as a percent (by weight) of the entire solid reducing agent charge added.

3. The method of claim 1 further comprising detecting sequential variations in blast pressure loss (PI) during the bast furnace operation and adjusting the amount of the solid reducing agent central charge such that the following formula (III) is satisfied:

$$(-0.263\times PI+2.63)<RWc<(0.263\times PI+2.83) \quad \text{(III)},$$

4. The method of claim 1, further comprising measuring the temperature at the center of the furnace hearth and determining a mean hearth center temperature in the furnace operation without the addition of solid central charge (Ts), calculating the difference between said measured hearth center temperature and Ts ($\Delta T$) and adjusting the amount of the central charge such that the relationship between said variation in furnace bottom temperature and RWc satisfy the condition of the following formula (IV):

$$\{0.58(T/Ts)^{1.4}\}<(RWc)<\{1.26(T/Ts)^{1.4}\}$$

Ts: Mean furnace hearth temperature in operation without center charging

T: Difference from the hearth temperature Ts in operation center charging of the solid reducing agent.

5. The method of claim 1 further comprising adjusting the amount of said central charge such that the minimum fluidization gas velocity ($U_{mf}$) of said central charge and a mean gas velocity ($U_t$) in the furnace top satisfy the condition of the following formula (V):

$$0.30\leqq U_t/U_{mf}\leqq 0.52 \quad \text{(V)},$$

* * * * *

UNITED STATES PATENT AND TRADEMARK OFFICE

CERTIFICATE OF CORRECTION

PATENT NO. : 4,963,186

DATED : October 16, 1990

INVENTOR(S) : MASATAKA SHIMIZU ET AL

It is certified that error appears in the above-indentified patent and that said Letters Patent is hereby corrected as shown below:

Column 10, line 42,

"$0.58(\Delta T/Ts)^{1.4}<RWc<1.26(\Delta T/Ts)^{1.4}$" should read

--$\Delta\{0.58(\Delta T/Ts)^{1.4}\}<\Delta(RWc)<\Delta\{1.26(\Delta T/Ts)^{1.4}\}$--.

Column 18, line 26, in Claim 4,

"$0.58(\Delta T/Ts)^{1.4}<(RWc)<\{1.26(\Delta T/Ts)\}^{1.4}$" should read

--$\Delta\{0.58(\Delta T/Ts)^{1.4}\}<\Delta(RWc)<\Delta\{1.26(\Delta T/Ts)^{1.4}\}$--.

Signed and Sealed this

Twenty-fourth Day of August, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,963,186

DATED : October 16, 1990

INVENTOR(S) : MASATAKA SHIMIZU ET AL

It is certified that error appears in the above-indentified patent and that said Letters Patent is hereby corrected as shown below:

Column 17, line 34, change "of 0.03" to -- $\leq$ 0.3--.

Signed and Sealed this

Sixteenth Day of August, 1994

*Attest:*

*Attesting Officer*

Bruce Lehman

BRUCE LEHMAN

*Commissioner of Patents and Trademarks*